US006467577B1

(12) United States Patent
Charlebois, Jr.

(10) Patent No.: US 6,467,577 B1
(45) Date of Patent: Oct. 22, 2002

(54) LADDER MATE

(76) Inventor: Edward A. Charlebois, Jr., P.O. Box 8, W. Bridgewater, MA (US) 02379

( * ) Notice: Subject to any disclaimer, the term of this patent is extended or adjusted under 35 U.S.C. 154(b) by 0 days.

(21) Appl. No.: 09/833,179

(22) Filed: Apr. 12, 2001

(51) Int. Cl.[7] ..... E04G 1/00
(52) U.S. Cl. ..... 182/129; 182/121; 182/122; 248/210; 248/238
(58) Field of Search ..... 182/121, 122, 182/129; 248/210, 238; 206/373

(56) References Cited

U.S. PATENT DOCUMENTS 2,444,096 A 6/1948 Faust
2,832,984 A * 5/1958 Peters ..... 15/264
2,865,546 A 12/1958 Shull
2,911,133 A 11/1959 Ruggieri
3,331,577 A 7/1967 Grunwaldt
4,913,394 A 4/1990 Schmid
4,936,463 A * 6/1990 Tiramani ..... 206/581
5,727,649 A * 3/1998 Buckley ..... 182/129
5,740,883 A * 4/1998 Trank ..... 182/129
5,826,718 A * 10/1998 Ahern, Jr. et al. ..... 206/372
5,873,433 A * 2/1999 Katz ..... 182/129
5,941,344 A * 8/1999 Spadaro ..... 182/129

* cited by examiner

*Primary Examiner*—Bruce A. Lev
(74) *Attorney, Agent, or Firm*—John P. McGonagle

(57) ABSTRACT

An open tool box with a cover positionable over a portion of the box. The cover is adapted to hook onto the top of a step ladder.

2 Claims, 3 Drawing Sheets

LADDER MATE

BACKGROUND OF THE INVENTION

This invention relates to tool boxes, and in particular, to a tool box specifically adapted for use with a step ladder.

Ladders are used extensively to support workers in an elevated position while they perform various tasks. Consequently, numerous devices have been developed expressly for the purpose of supporting articles, such as tools, fasteners, materials, containers, and the like, upon a ladder. In spite of this, a particular limitation of prior art devices is the difficulty in using these devices in environments other than with a ladder. It is believed that applicant's invention, as defined hereinafter, contains novel features particularly useful in assisting a worker in performing a wide variety of tasks, with and without a ladder.

SUMMARY OF THE INVENTION

The present invention addresses the problem of prior art devices by providing a tool box which, while particularly adapted to use with a step ladder, may be used independently of the ladder. The present invention provides an open tool box with a cover positionable over a portion of the box. The cover is also adapted to hook onto the top of a step ladder.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
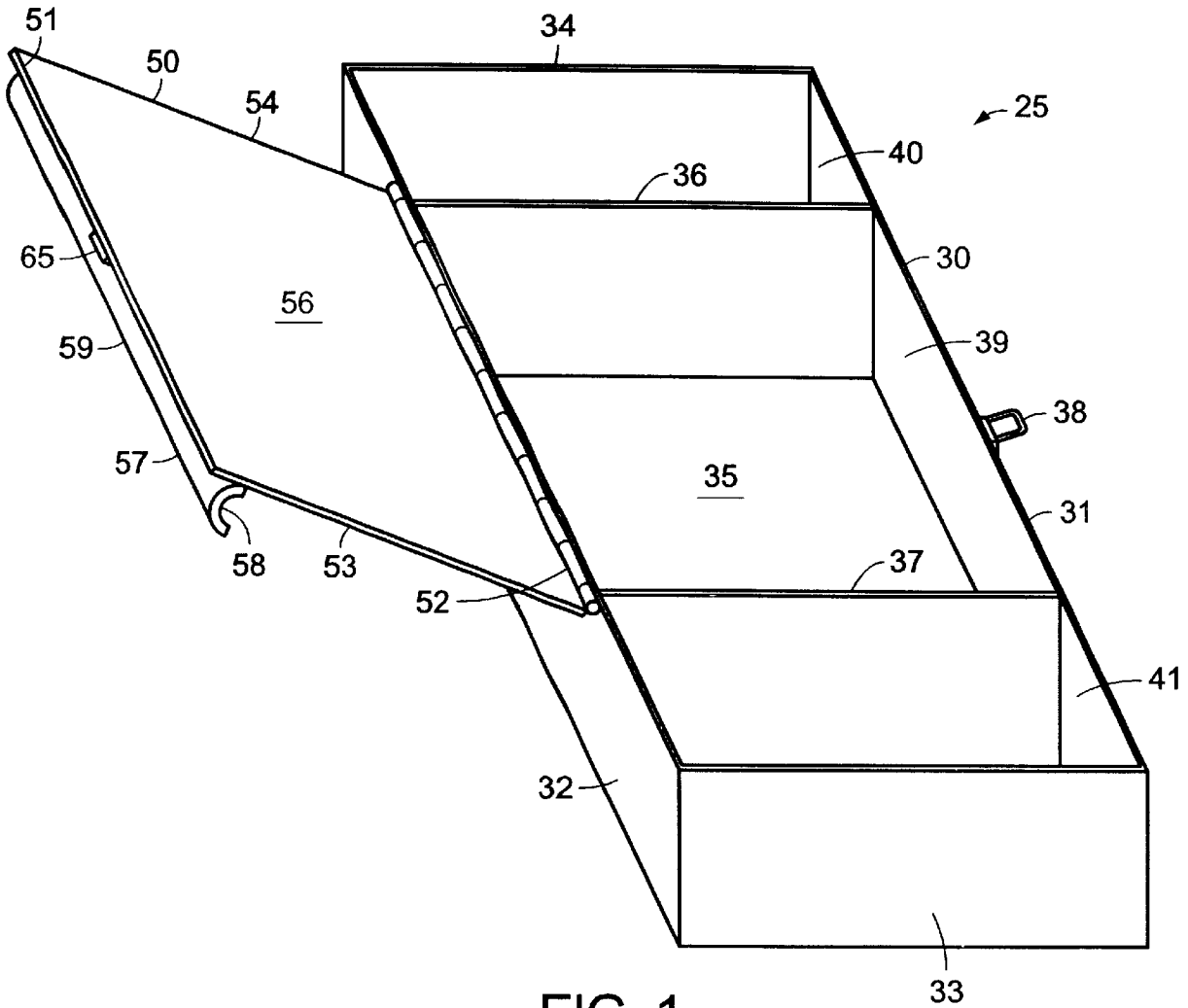
FIG. 1 is a perspective view of a ladder mate tool box.
Figure 2:
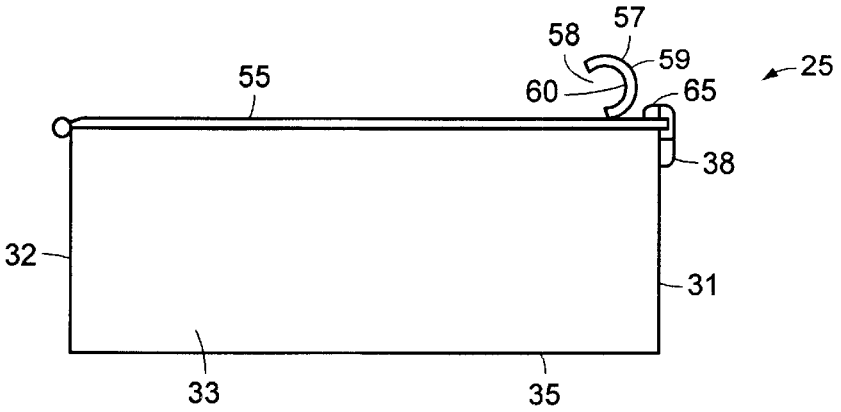
FIG. 2 is a side view of the tool box with the cover closed.
Figure 3:
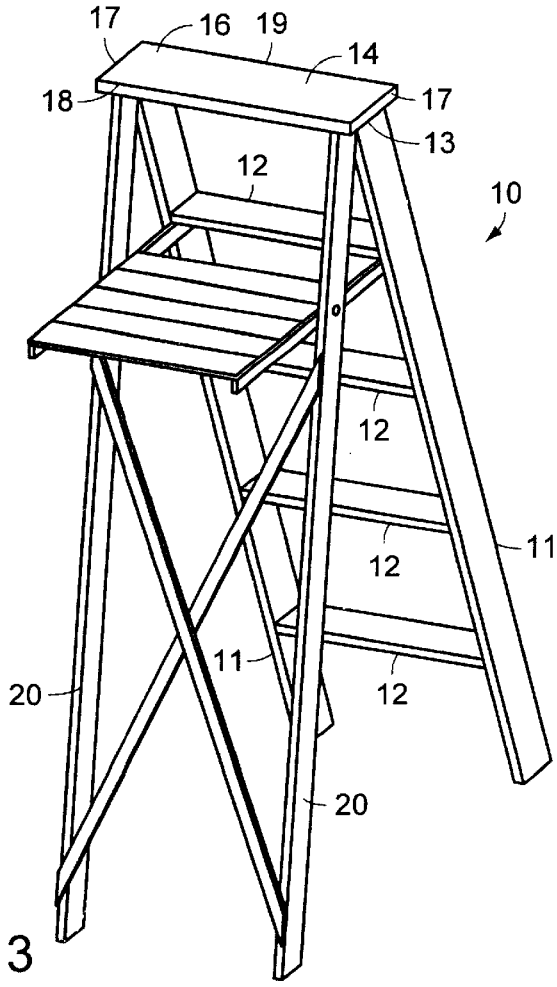
FIG. 3 is a perspective view of a step ladder.
Figure 4:
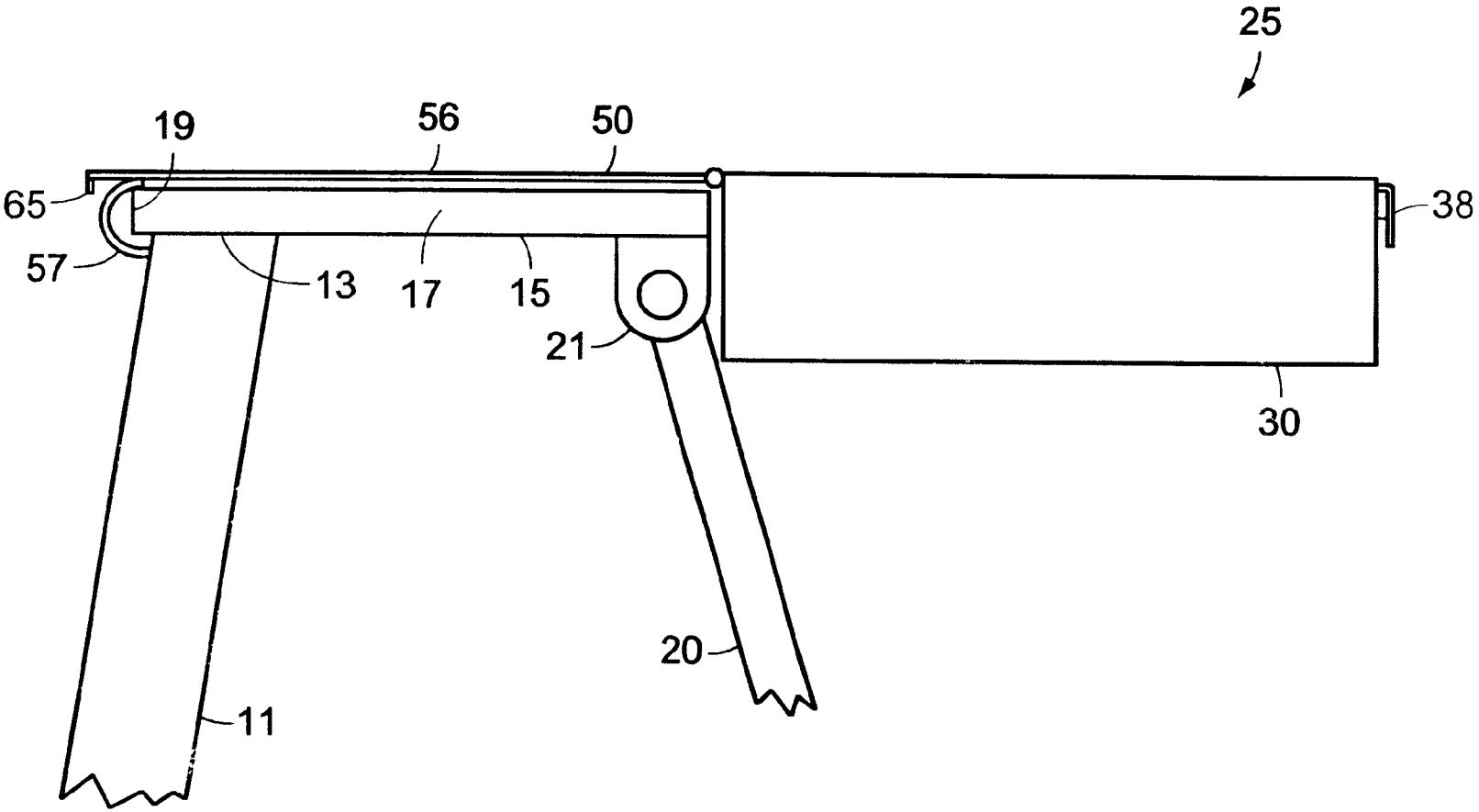
FIG. 4 is a side view of the tool box with the cover open and engaged to a step ladder.

Referring to the drawings in detail wherein like elements are indicated by like numerals, there is shown a ladder mate tool box 25 constructed according to the principles of the present invention. The tool box 25 is particularly adapted to engage a step ladder 10.

The step ladder 10 shown is comprised of at least two, main, upright rails 11 and a number of horizontal steps 12 interconnecting the rails 11. The tops 13 of the rails 11 usually terminate in a generally flat, rectangular, horizontal platform 14. The platform 14 has an underside 15, a top side 16, two side edges 17, a forward edge 18 and a rearward edge 19, said rails 11 terminating in the platform underside 15 near to the rearward edge 19 and side edges 17. The platform 14 has a pair of downwardly extending legs 20 pivotally attached to the platform underside 15 by means of pivots 21 positioned near to the forward edge 18 and side edges 17.

The tool box 25 is made out of a sturdy, lightweight material such as plastic or metal and has a generally rectangular base 30 and corresponding cover 50. The base 30 is comprised of a substantially parallel front 31 and rear 32 walls, substantially parallel side walls 33 and 34, and a flat bottom 35 extending from the front 31 to rear 32 walls and from side wall 34 to side wall 35. The longitudinal axis of the base 30 is defined by the side walls 33, 34. The base 30 has two divider walls 36 and 37 parallel to the side walls 33, 34 and extending from the front 31 wall to the rear wall 32. Other divider walls may be added or subtracted to increase or decrease the number of compartments formed thereby. In this embodiment of the invention, the divider walls 36, 37 are each positioned approximately one quarter of the longitudinal distance from a side wall 36, 37, respectively. The area defined by the divider walls 36, 37, front wall 31, rear wall 32 and bottom 35 is termed the central compartment 39. The area defined by the side wall 34, divider wall 36, front wall 31, rear wall 32 and bottom 35 is termed an outer compartment 40. The area defined by the side wall 33, divider wall 37, front wall 31, rear wall 32 and bottom 35 is also termed an outer compartment 41.

The cover 50 is generally flat and has four edges, a front edge 51, a rear edge 52, and two sides edges 53 and 54, respectively. The cover rear edge 52 is pivotally hinged along its length to the top edge of the base rear wall 32. The cover 50 has a top surface 55 and bottom surface 56. An elongated element 57 having a half-round cross section is attached to the top surface 55 near to the cover front edge 51 and extending nearly from side edge 53 to side edge 54. The element 57 has a central longitudinal axis parallel to the cover front edge 51. The element 57 has an elongated opening 58 defined by the half-round cross section and extending the length of the element 57, said opening 58 facing rearward toward the cover rear edge 52. The element 57 has an external surface 59 and an interior surface 60 accessible through the opening 58. The cover 50 has a longitudinal axis and width defined by the side edges 53, 54. The width of the cover 50 is approximately equal to the distance between the base divider walls 36, 37, whereby only the base central compartment 39 may be covered. The base front wall 31 has a latch 38 attached thereto. The cover top surface 55 has a corresponding latch receptacle 65 attached thereto adjacent to the front edge 51. The latch 38 is adapted to be removably engaged to the latch receptacle 65.

In operation, the tool box 25 may be used in two different modes. In the first mode, the tool box 25 may be used as a regular tool box with a closable cover. Tools, fasteners, materials, containers, and the like, may be carried in the central compartment 39. The cover 50 is closable over the central compartment 39 by means of the latching arrangement 38, 65. The elongated element 57 with its elongated opening 58 provides a means for carrying the tool box 25, i.e., fingers may be slipped into the opening 58 against the interior surface 60 while the curved outer surface 59 of the element 57 fits into a person's palm. The outer compartments 40, 41 are used primarily while performing work. The outer compartments 40, 41 provide a place to temporarily hold tools, fasteners, materials, containers, and the like, while the central compartment 39 will generally hold those items not immediately required for the task at hand.

In the second mode, the tool box 25 is used in conjunction with a step ladder 10. The box 25 is opened and the cover 50 is positioned over the step ladder platform top side 16. The tool box elongated cover element opening 58 is positioned over and engages the platform rearward edge 19. The tool box base rear wall 32 rests against the step ladder legs 20. The tool box 25 is thereby open and fully accessible to a worker standing on the step ladder steps 12. When finished, the worker disengages the tool box cover element

57, removes the tool box 25 from the step ladder 10, closes the tool box 25 and removes the tool box 25 to any desired location.

It is understood that the above-described embodiment is merely illustrative of the application. Other embodiments may be readily devised by those skilled in the art which will embody the principles of the invention and fall within the spirit and scope thereof.

I claim:

1. A tool box adapted for use with a step ladder, said step ladder having at least two, main, upright rails and a number of horizontal steps interconnecting the rails, said rails having tops terminating in a generally flat, rectangular, horizontal platform, said platform having an underside, a top side, two side edges, a forward edge and a rearward edge, said rails terminating in the platform underside near to the rearward edge and side edges, said platform having a pair of downwardly extending legs pivotally attached to the platform underside by means of pivots positioned near to the forward edge and side edges, comprising:

an open top tool box with a generally rectangular base, said base having substantially parallel front and rear walls, substantially parallel side walls, and a flat bottom extending from the front to rear walls and from side wall to side wall, said side walls defining the longitudinal axis of the base, said tool box having a plurality of divider walls within the base parallel to the side walls and extending from the front wall to the rear wall, said divider walls, front wall, rear wall and bottom defining a central compartment, said side walls, divider wall, front wall, rear wall and bottom each defining an outer compartment; and a generally flat cover positionable over a portion of the box, said cover having a top surface, bottom surface, a front edge, a rear edge and two parallel, opposite side edges, said rear edge being pivotally hinged along its length to a top edge of the base rear wall, said cover having an elongated element having a half-round cross section fixedly attached to the cover top surface near to the cover front edge and extending nearly from side edge to side edge, said elongated element having a central longitudinal axis parallel to the cover front edge, said elongated element having an elongated opening defined by the half-round cross section and extending the length of the elongated element, said opening facing rearward toward the cover rear edge, said elongated element having an external surface and an interior surface accessible through said opening, said cover having a longitudinal axis and width defined by the side edges, said cover width being approximately equal to a distance between said box divider walls whereby only the box central compartment may be covered;

wherein said cover is adapted to being positioned over the step ladder platform top side, said cover element opening adapted to be positioned over and engaging the platform rearward edge, said tool box base rear wall adapted to be resting against said step ladder legs.

2. The tool box as recited in claim 1, further comprising:

a latch attached to said base front wall; and a latch receptacle corresponding to said latch, said receptacle being attached to said cover top surface adjacent to the front edge;

wherein said latch is adapted to be removably engaged to the latch receptacle.

* * * * *